US006374459B1

(12) United States Patent
Zetti

(10) Patent No.: US 6,374,459 B1
(45) Date of Patent: Apr. 23, 2002

(54) SNAP HINGE FOR SUPPORTING CLOSURE SHEET-LIKE ELEMENTS

(75) Inventor: Daniele Zetti, Modena (IT)

(73) Assignee: T.G.N. S.p.A., Modena (IT)

( * ) Notice: Subject to any disclaimer, the term of this patent is extended or adjusted under 35 U.S.C. 154(b) by 0 days.

(21) Appl. No.: 09/414,539

(22) Filed: Oct. 8, 1999

(30) Foreign Application Priority Data

Oct. 13, 1998 (IT) ..... MO98A0210

(51) Int. Cl.[7] ..... E05D 15/32; E05D 5/00

(52) U.S. Cl. ..... 16/366; 16/368; 16/369; 16/370; 16/286; 16/287; 16/288; 16/323

(58) Field of Search ..... 16/366, 370, 286, 16/287, 288, 323

(56) References Cited

U.S. PATENT DOCUMENTS 3,363,281 A * 1/1968 Borsani ..... 16/163
4,236,272 A * 12/1980 Gronbach et al. ..... 16/145
4,587,760 A * 5/1986 Brissette ..... 49/252
4,862,555 A * 9/1989 Grass ..... 16/291
5,035,026 A * 7/1991 Carlo et al. ..... 16/288
5,058,238 A 10/1991 Lautenschlaeger
5,103,532 A * 4/1992 Youngdale et al. ..... 16/288
5,497,534 A 3/1996 Caruso
5,664,290 A * 9/1997 Scherrer ..... 16/370
6,243,918 B1 * 6/2001 Zetti ..... 16/298

* cited by examiner

*Primary Examiner*—Anthony Knight
*Assistant Examiner*—Matthew E. Rodgers
(74) *Attorney, Agent, or Firm*—Guido Modiano; Albert Josif; Daniel O'Byrne

(57) ABSTRACT

A snap hinge for supporting closure sheet-like elements, comprising a first articulated quadrilateral and a second articulated quadrilateral which have a first lever and a second lever in common, at least two elastic springs in parallel being further provided.

13 Claims, 5 Drawing Sheets

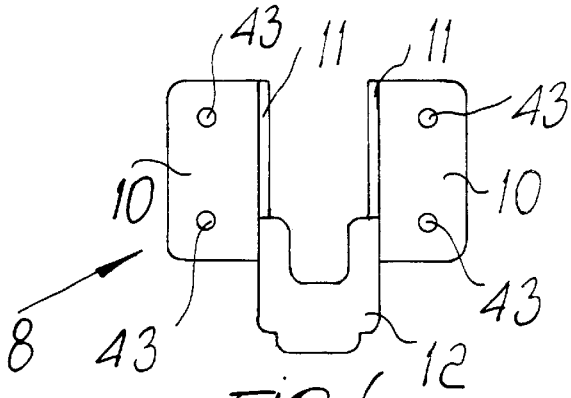
FIG. 6
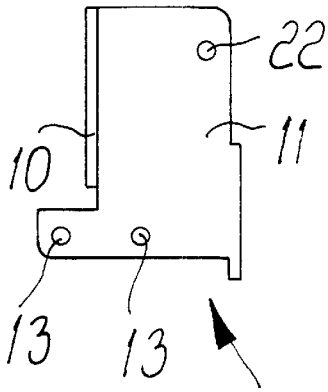
FIG. 7
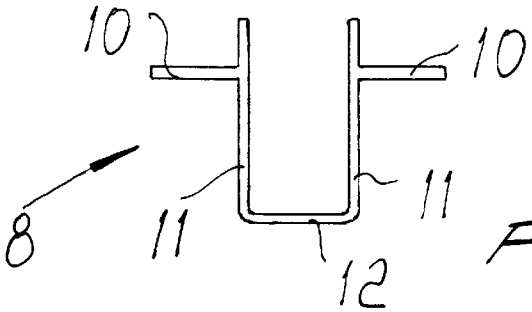
FIG. 8
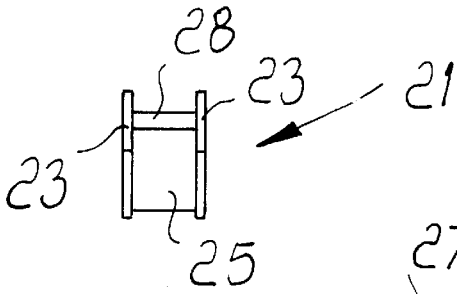
FIG. 9
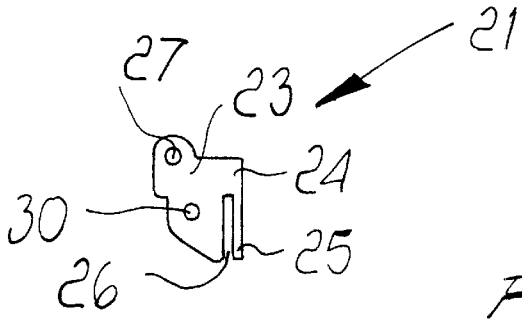
FIG. 10
FIG. 11
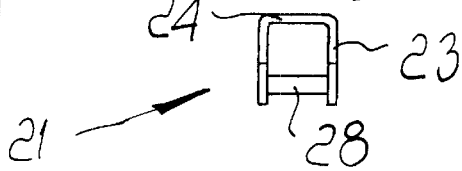

SNAP HINGE FOR SUPPORTING CLOSURE SHEET-LIKE ELEMENTS

BACKGROUND OF THE INVENTION

The present invention relates to a snap hinge for supporting closure plate-like or sheet-like elements, i.e. a hinge which is adapted to produce the snap closure and opening of doors and leaves, particularly in pieces of furniture, in caravan cabinets, in bins and in applications in general in which in order to pass from the open position to the closed position the sheet-like elements rotate about a substantially horizontal or optionally inclined hinge axis.

Hinges for pieces of furniture and the like are known which have a twin articulated quadrilateral and an enclosed spring which is optionally provided with a monolithic pusher lever, as in Italian patent no. 1,269,279 filed on Dec. 16, 1994 in the name of the same Applicant, producing snap opening and closure over an extent approximately equal to a right angle.

These hinges are not free from drawbacks, including the fact that they do not allow stable opening and closure and do not support the door sufficiently when it moves from the vertical position to a horizontal position in which the weight of the door itself acts particularly intensely on the hinges.

Accordingly, one obtains a smaller-than-expected degree of opening and/or an excessively weak closure, to the point of causing, for example in the case of application to caravans, accidental opening of the cabinet door on bends, causing the consequent escape of the contents of the cabinet.

Hinges adapted for recessed mounting, of the type with an articulated quadrilateral and a spring, are also known; they are applied so that one of the base plates is fixed in a recess formed within the thickness of the door so as to slightly increase the movement arm.

However, even these hinges do not ensure good stability of the doors, require molds or machining in order to obtain said recess, leading to a considerable production cost increase, and tend to make the door slam violently against the piece of furniture or cabinet during closure.

SUMMARY OF THE INVENTION

The aim of the present invention is to eliminate the above-described drawbacks of conventional hinges by providing a snap hinge for supporting closure sheet-like elements which allows to stably support the sheet-like element between the vertical position and the horizontal position, to provide stable closure and opening, to support very intense loads, to prevent the door from violently slamming against the piece of furniture or cabinet during closure, and to perform simple and straightforward assembly without having to form recesses and without resorting to molded doors provided with a recess.

Within the scope of this technical aim, an object of the present invention is to achieve the above-cited aim with a structure which is simple, relatively easy to provide in practice, safe in use, effective in operation and relatively low in cost.

This aim, object and others are both achieved by the present snap hinge for supporting closure sheet-like elements, comprising a first articulated quadrilateral and a second articulated quadrilateral which have a first lever and a second lever in common, characterized in that it is provided with at least two elastic means in parallel.

BRIEF DESCRIPTION OF THE DRAWINGS

Further characteristics and advantages of the present invention will become apparent from the following detailed description of a preferred but not exclusive embodiment of a snap hinge for supporting closure sheet-like or plate-like elements, illustrated only by way of non-limitative example in the accompanying drawings, wherein:

FIG. 6 is a plan view of a coupling plate of the hinge according to the invention;

FIG. 7 is a side view of the plate of FIG. 6;

FIG. 8 is a front view of the plate of FIG. 6;

FIG. 9 is a top view of a support of the hinge according to the invention;

FIG. 10 is a side view of FIG. 9;

FIG. 11 is a top view of FIG. 10;

DESCRIPTION OF THE PREFERRED EMBODIMENTS

Figure 1:
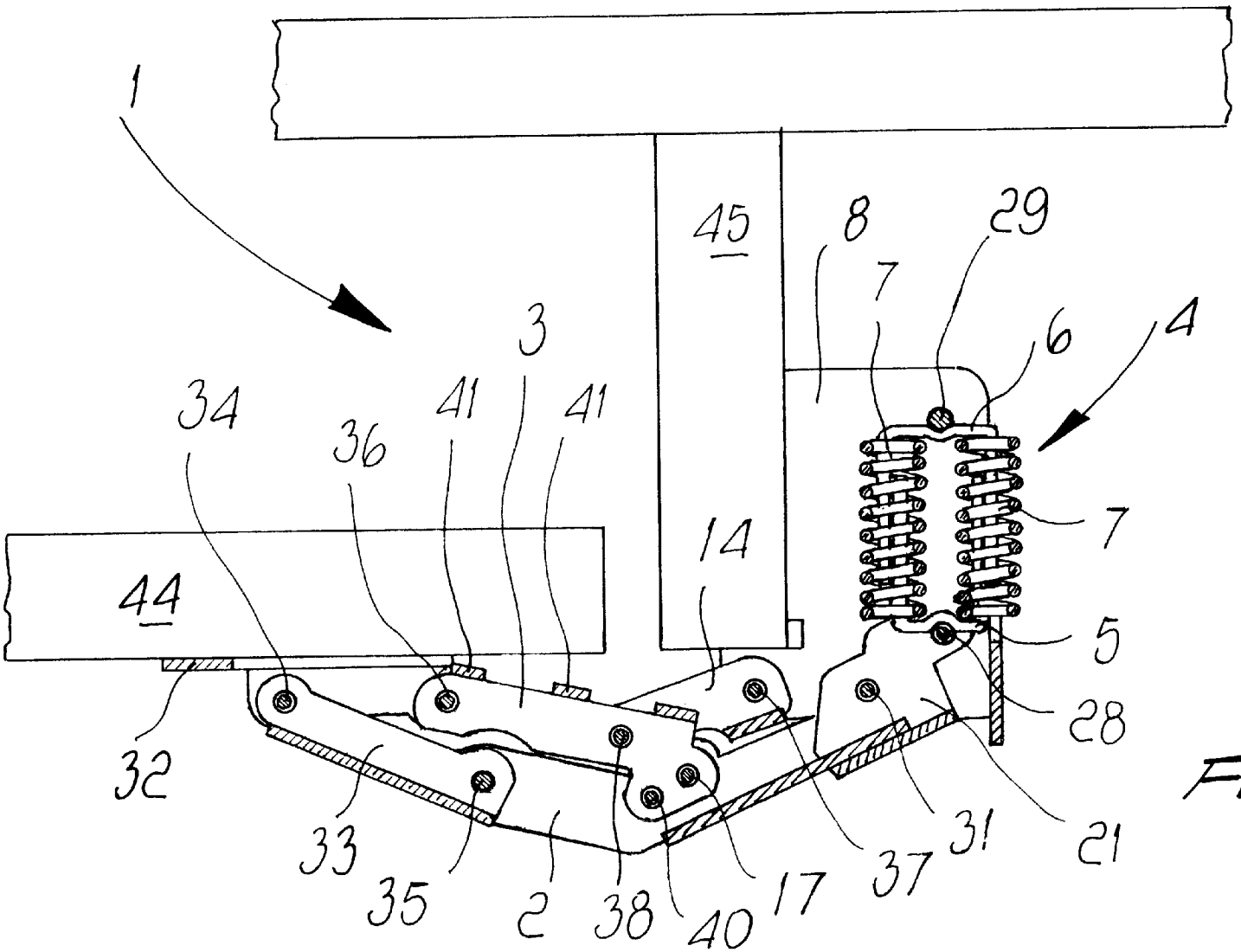
FIG. 1 is a sectional side view of a snap hinge according to the invention, applied to two sheet-like elements, with the lower element in the horizontal open position.
Figure 2:
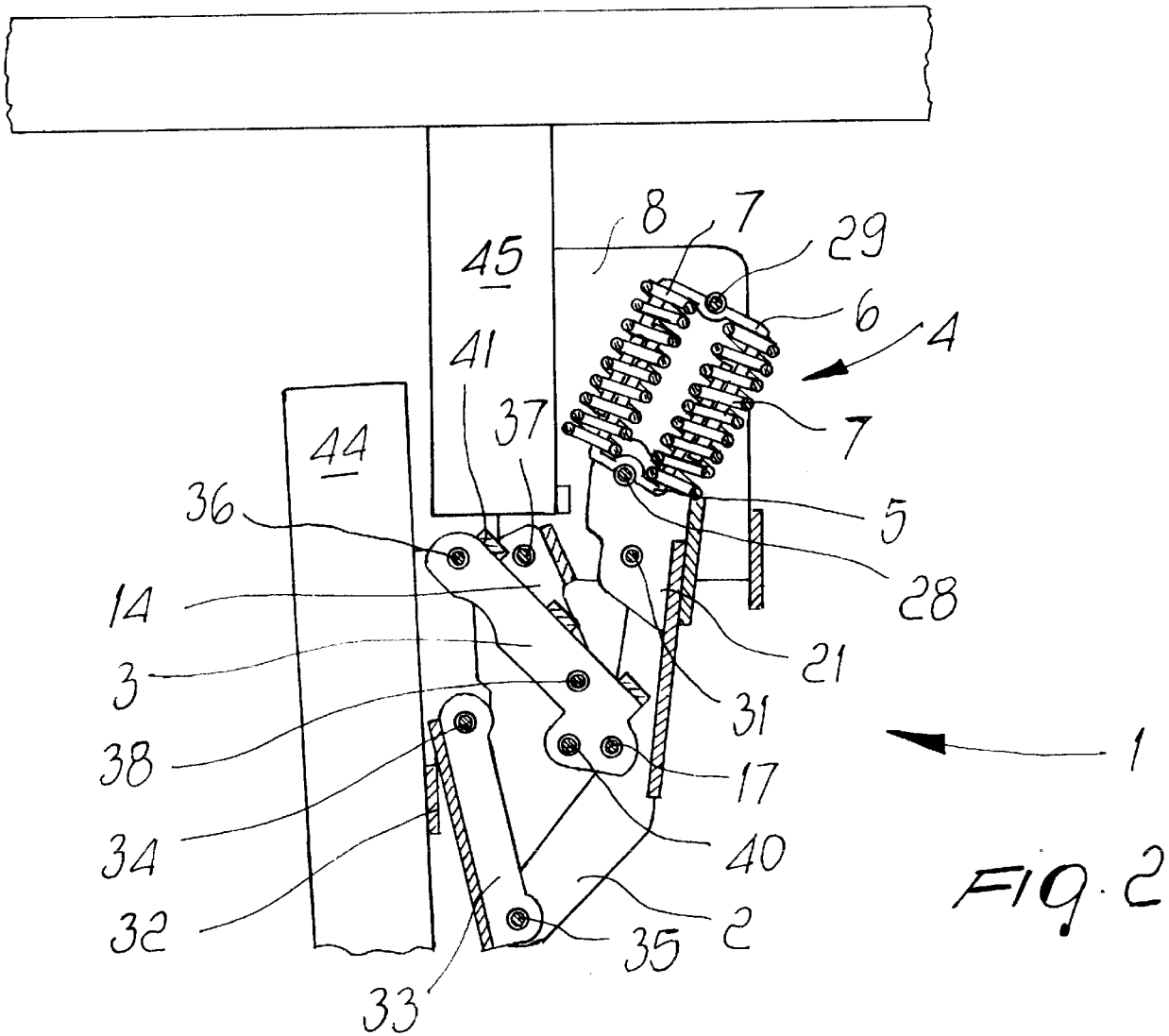
FIG. 2 is a sectional side view of the hinge of FIG. 1, but in the closed position.
Figure 3:
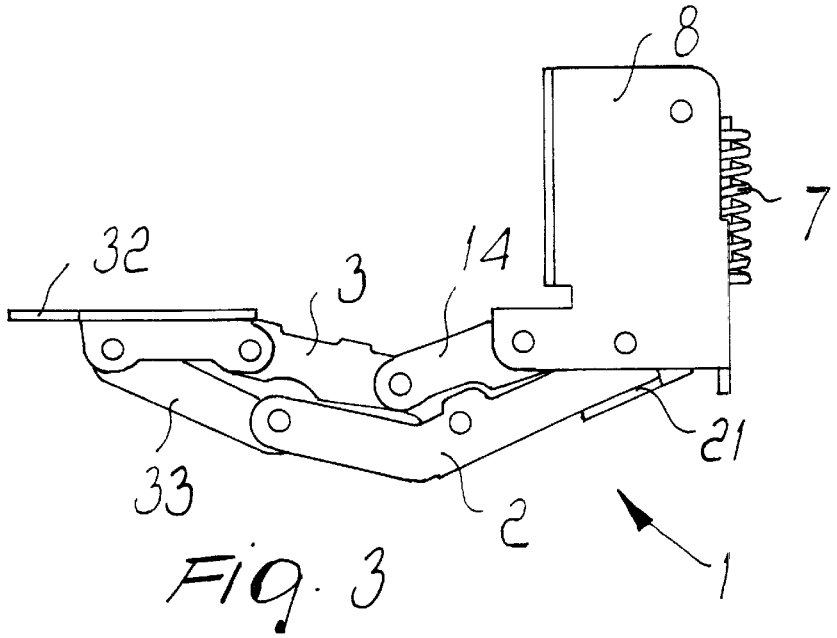
FIG. 3 is a side view of the hinge according to the invention.
Figure 4:
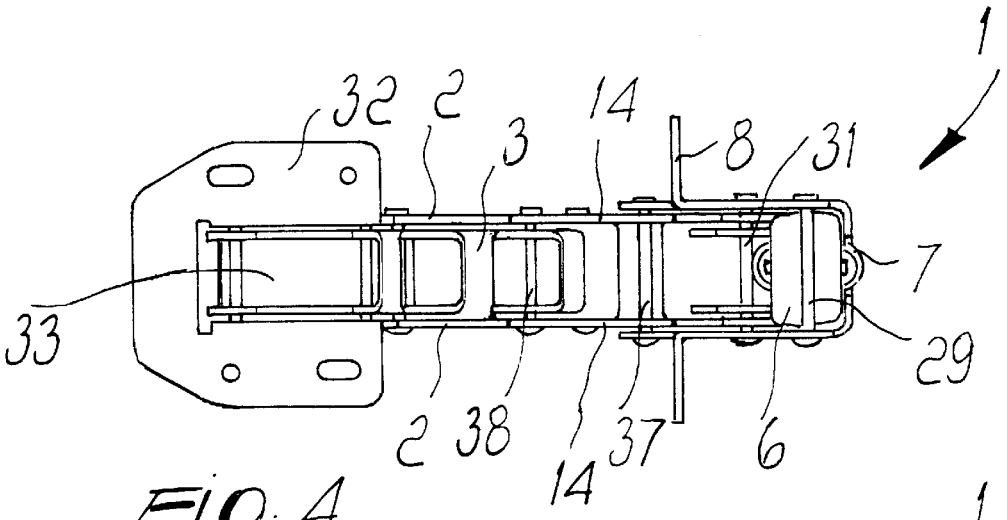
FIG. 4 is a top view of the hinge of FIG. 3.
Figure 5:
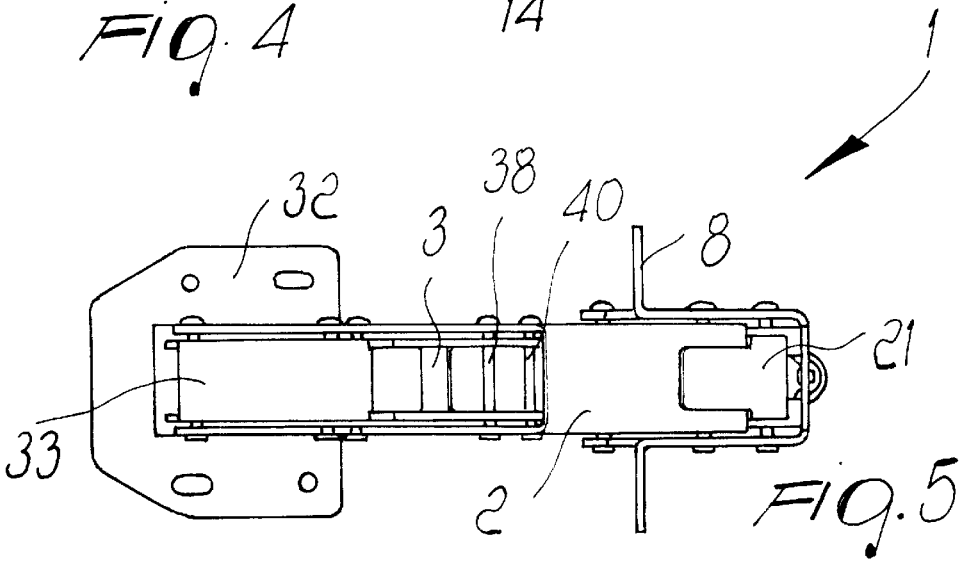
FIG. 5 is a bottom view of the hinge of FIG. 3.
Figure 12:
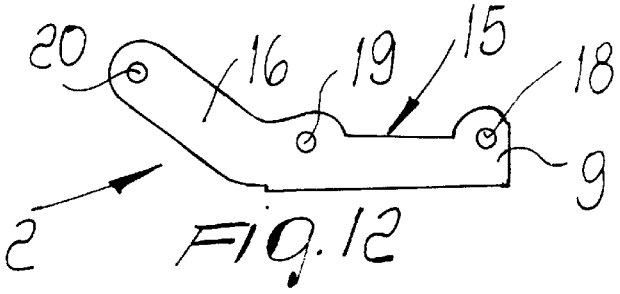
FIG. 12 is a side view of the first lever of the hinge according to the invention.
Figure 13:
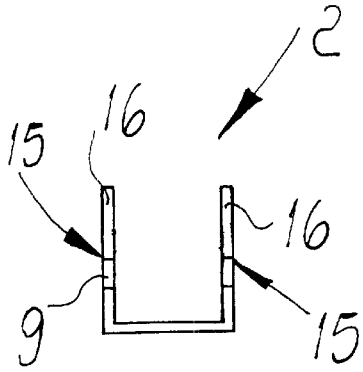
FIG. 13 is a front view of the lever of FIG. 12.
Figure 14:
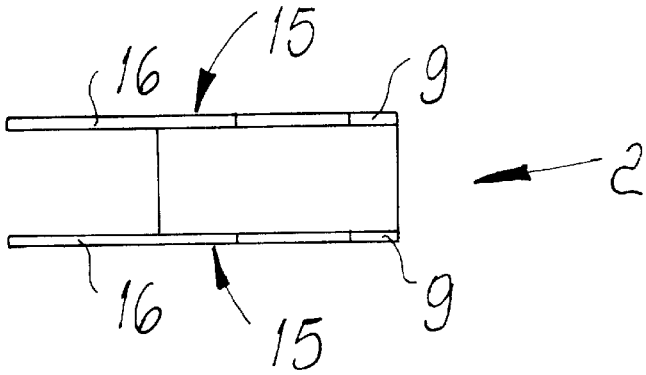
FIG. 14 is a plan view of the lever of FIG. 12.
Figure 15:
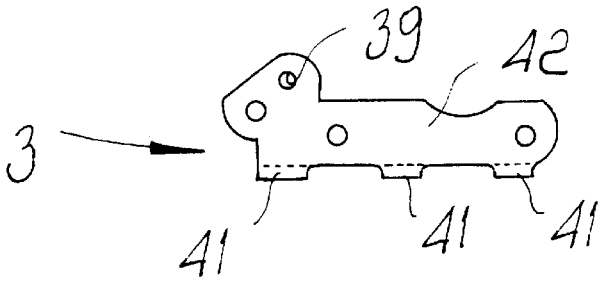
FIG. 15 is a side view of the second lever of the hinge according to the invention.
Figure 16:
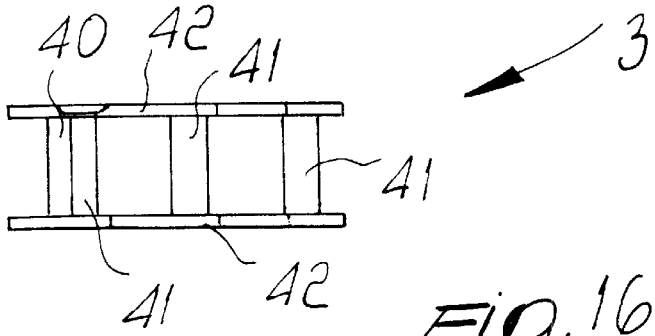
FIG. 16 is a plan view of the lever of FIG. 15.

With reference to the above figures, the reference numeral 1 generally designates a snap hinge for supporting closure sheet-like elements according to the invention.

The hinge 1 comprises two articulated quadrilaterals having a first lever 2 and a second lever 3 in common, and two elastic means 4 which are constituted by two mutually opposite elements 5 and 6 for guiding and supporting two mutually parallel springs 7.

In the embodiment shown in the various figures, the elastic means 4 are springs of the cylindrical helical type: these springs are guided and supported by the mutually opposite elements 5 and 6, which are in turn anchored to a coupling plate 8.

One end of the first lever 2 extends towards the plate 8 with two lugs 9 and receives the thrust applied by the elastic means 4 anchored to the plate.

The plate 8 comprises a body provided with two bases 10 which are connected by respective side faces 11 which are in turn connected by a connecting bridge 12.

The side faces 11 are provided with two pairs of holes 13 in a position which corresponds to the position of the connecting bridge 12 for the articulated connection of the plate 8 to the first lever 2 and to the arm 14 of the first articulated quadrilateral.

The first lever 2 comprises two side faces 15 which are provided with respective arms 16 located on the opposite side with respect to the lugs 9 and are perforated in their intermediate part for the insertion of a pivot 17 for rotary connection to the second lever 3.

Each side face 15 is provided with at least three holes: a first hole 18, which is formed in the lug 9; a second intermediate hole 19; and a third hole 20, provided towards the end of the arm 16.

The first lever 2 is associated, towards the coupling plate 8, with a support 21 which can be locked in place at the end of first lever 2 and is adapted to receive the thrust of the elastic means 4.

The side faces 11 of the coupling plate 8 are further provided with a third pair of holes 22 in a position which is substantially opposite to the position of the connecting bridge 12.

The support 21 is constituted by two sides 23 connected by a bridge 24 which extends with a tab 25 separated from the pair of sides 23 by means of two notches 26 inserted and locked in place the end of the first lever 2 that is directed towards the coupling plate 8.

Each side 23 is provided with a first hole 27 for the insertion of the pivot 28 for supporting the end of the guiding and supporting element 5, while the end of the guiding and supporting element 6 rests against the pivot 29 inserted in the third pair of holes 22 of the sides faces 11 of the coupling plate 8.

Each side 23 is also provided with a second hole 30 for the insertion therein of a pivot 31 for connecting the side faces 11 of the coupling plate 8, the side and the tab 9 of the first lever 2.

The elements composing the two quadrilaterals of the hinge 1 are constituted as follows: the first one is constituted by the conventional coupling plate 32, by the arm 33 and by the two levers 2 and 3, which are articulated in the pivots 34, 35, 36 and 17; the second one is constituted by the bridge-like coupling plate 8, by the arm 14 and by the levers 2 and 3, which are articulated to the pivot 31, 37, 17 and 38.

Advantageously, the second lever 3 is provided with two holes 39 for the insertion of a pivot 40: it is therefore possible to provide a third spring, not shown, which applies the thrust to the pivot 40 and is rotationally locked onto the pivot and on the pivot 35.

The second lever 3 further comprises a set of three dorsal bridges 41 for connecting the side faces 42, as an alternative, the lever 3 can also have a prism-like cross-section.

The coupling plate 8 is generally fixed in an upper vertical position and its bridge 12 is staggered and protrudes, joining in a downward region the two side faces 11 of the bases 10, having fixing holes 43.

Accordingly, the actions applied by the two springs 7 develop on the first lever 2, with the result of keeping the hinge 1 stable in the two extreme open and closed positions, being able in particular to bear the weight of the plate-like element 44 horizontally with respect to the sheet-like element 45, which is fixed vertically.

In an alternative embodiment, it is possible to provide a first so-called monolithic lever which is provided with at least four pairs of holes as a replacement for the lever 2 and the support 21 which are mutually interlock-connected.

In practice, it has been observed that the above-described invention achieves the intended aim and object.

The invention thus conceived is susceptible of several modifications and variations, all of which are within the scope of the inventive concept.

All the details may further be replaced with other technical equivalent ones.

In practice, the materials employed, as well as the shapes and the dimensions, may be any according to requirements without thereby abandoning the protective scope of the appended claims.

The disclosures in Italian Patent Application No. M098A000210 from which this application claims priority are incorporated herein by reference.

What is claimed is:

1. A snap hinge for supporting closure sheet elements, comprising:

a first articulated quadrilateral constituted by a coupling plate connectable to a movable sheet element, by a first arm, by a first lever, and by a second lever, said first arm being pivoted at opposite ends thereof to said coupling plate and first lever, respectively, and said second lever being pivoted at opposite ends thereof to said coupling plate and first lever respectively;

a second articulated quadrilateral constituted by a bridge coupling plate connectable to a further sheet element, by a second arm and by said first and second levers in common with said first articulated quadrilateral, said second arm being pivoted at opposite ends to said bridge coupling plate and second lever, respectively; and at least two elastic means arranged in parallel to exert a thrusting action between said bridge coupling plate and an end of said first lever so as to keep the hinge stable in two extreme open and closed positions and withstand the weight of said movable sheet element.

2. The hinge of claim 1, wherein said at least two elastic means comprise springs arranged parallel to each other and two mutually opposite elements for guiding and supporting said two springs.

3. The hinge of claim 2, wherein said springs are of the cylindrical helical type.

4. The hinge of claim 2, wherein said first lever is provided at the end thereof undergoing said thrusting action with two lugs on which said elastic means act.

5. The hinge according to claim 4, wherein said elastic means are anchored to said bridge-like coupling plate.

6. The hinge of claim 4, wherein said bridge coupling plate comprises a body provided with two bases, two side faces connecting said bases, a connecting bridge interconnecting said side faces, and two pairs of holes, provided at said side faces, for pivoting connection of said bridge plate to said first lever and to said second arm.

7. The hinge of claim 6, further comprising a support which is fitted and locked in place at the end of said first lever where the thrusting action of said elastic means is exerted.

8. The hinge of claim 4, wherein said first lever comprises a body provided with two side faces which have respective arms extending at an end of said first lever which is opposite to the end provided with said two lugs, and perforations provided at an intermediate part of said side faces for allowing pivoting connection of said first lever to said second lever.

9. The hinge of claim 8, wherein each one of said side faces of said first lever is provided in corresponding positions with at least three holes, first holes being provided each in a respective one of said two lugs, second holes constituting said intermediate perforations, and third holes being located towards free ends of said respective arms.

10. The hinge of claim 7, wherein said bridge coupling plate comprise, arranged at ends of said side faces located opposite to said connecting bridge, a third pair of holes and a pivot being inserted for support in said third pair of holes.

11. The hinge of claim 10, wherein said support is constituted by two sides, by a bridge connecting said sides, by a tab extending from said bridge, said tab being separated from said two sides by way of a pair of notches, by respective first holes provided at each one of said sides for pivoting connection to a first one of said guiding and supporting elements, a second one of said guiding and supporting elements resting against said pivot inserted in said third pair of holes.

12. The hinge according to claim 11, wherein said support further comprises second holes provided at respective ones of said two sides and a connection pivot inserted in said second holes of the support and to which the side faces of said bridge coupling plate and the lugs of said first lever are connected.

13. The hinge of claim 11, wherein said notches are locked by way of an interlocking coupling in said end of said first lever at which said thrusting action of said elastic means is exerted.

* * * * *